US006283317B1

(12) United States Patent
Benoît-gonin et al.

(10) Patent No.: US 6,283,317 B1
(45) Date of Patent: Sep. 4, 2001

(54) SYNTHETIC TOP WITH ARTICULATED CAP ON A RING

(75) Inventors: Claude Benoît-gonin, Odenas; Jean-Yves Rognard, Marcy-sur-anse, both of (FR)

(73) Assignee: Crown Cork & Seal Technologies Corporation, Alsep, IL (US)

( * ) Notice: Subject to any disclaimer, the term of this patent is extended or adjusted under 35 U.S.C. 154(b) by 0 days.

(21) Appl. No.: 09/445,727

(22) PCT Filed: Jun. 5, 1998

(86) PCT No.: PCT/FR98/01158

§ 371 Date: Dec. 9, 1999

§ 102(e) Date: Dec. 9, 1999

(87) PCT Pub. No.: WO98/56675

PCT Pub. Date: Dec. 17, 1998

(30) Foreign Application Priority Data

Jun. 10, 1997 (FR) ..... 97.07399

(51) Int. Cl.[7] ..... B65D 47/10

(52) U.S. Cl. ..... 215/235; 215/253; 220/847; 222/556; 222/541.6

(58) Field of Search ..... 215/235, 237, 215/306, 253, 254, 256; 220/837, 838, 847, 375; 222/556, 153.07, 541.6, 541.9

(56) References Cited

U.S. PATENT DOCUMENTS

| | | | | |
|---|---|---|---|---|
| 3,991,904 | * | 11/1976 | Davis et al. | 215/256 X |
| 4,129,226 | * | 12/1978 | Percival | 215/253 X |
| 4,749,108 | * | 6/1988 | Dornsbusch | 222/556 X |
| 4,984,716 | * | 1/1991 | Beck | 222/153.07 X |
| 5,335,802 | * | 8/1994 | Brach et al. | 215/253 X |
| 5,785,209 | * | 7/1998 | Guglielmini | 222/153.07 |
| 5,810,207 | * | 9/1998 | Hayashida | 222/153.07 |

* cited by examiner

*Primary Examiner*—Nathan J. Newhouse
(74) *Attorney, Agent, or Firm*—Cantor Colburn LLP

(57) ABSTRACT

The present invention is directed towards a top for closing a container, comprising a hinge for articulating the cap on the ring at the container opening plane or above the latter. The top further comprises a boss projecting inside the top provided on the ring beneath the hinge articulating the cap on the ring.

9 Claims, 3 Drawing Sheets

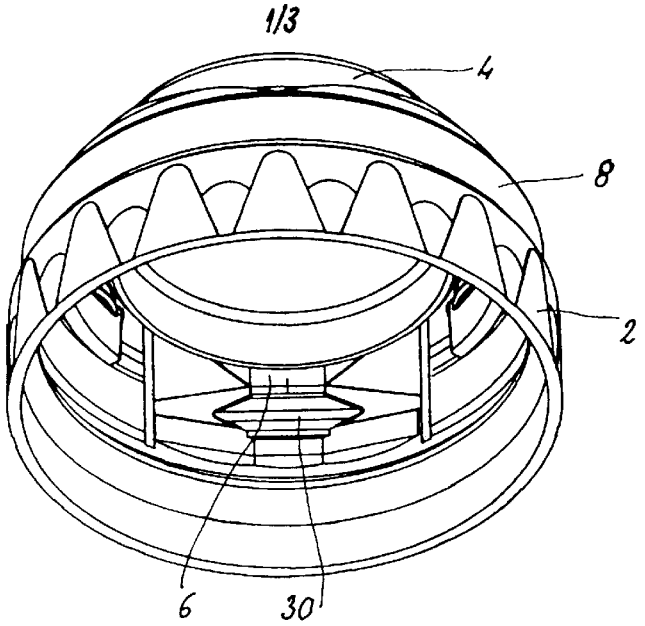
FIG1
FIG2
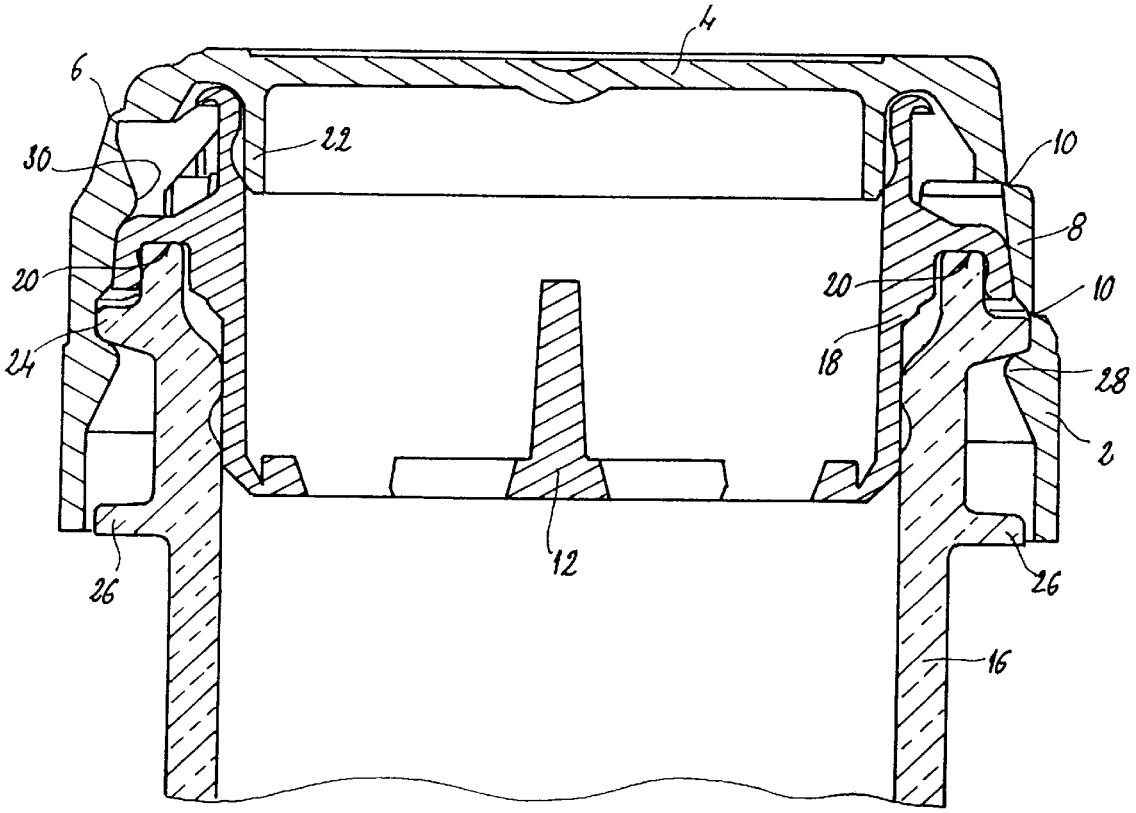

SYNTHETIC TOP WITH ARTICULATED CAP ON A RING

TECHNICAL FIELD

The present invention relates to a stopper made of synthetic material having a cap hinged to a band.

BACKGROUND OF THE INVENTION

This type of stopper is used, for example, on a container such as a bottle intended to be filled with a liquid. Optionally, a pourer is used in order to allow the liquid to be poured out while preventing, at the end of pouring, a drop of liquid from flowing along the bottle. The hinged cap allows the bottle to be opened and closed every time it is used, and without the risk of losing the cap. Often this type of stopper is provided with means allowing evidence of the first time it is opened.

This stopper therefore comprises two parts: a belt and a cap as well as, optionally, a tamper-evident ring connecting the band to the, cap over a large part of the perimeter of the cap. The band surrounds the external upper part of the neck of the bottle and, optionally, even extends above the plane of opening of the bottle. The cap is connected to the band by a hinge and, in the closed position, occludes the pourer. U.S. Pat. No. 4,984,716 shows such a stopper.

Before the cap is opened for the first time, the tamper-evident ring, or frangible connecting straps, connects the cap to the band. After tearing this ring, or breaking the connecting straps, only the hinge forms the link between these two parts. The band is held in place on the neck of the bottle quite poorly. It is difficult to fasten it. The cap helps to hold it in place. However, when the cap is open, or even when it is closed but the tamper-evident ring has been removed, or the connecting straps have been broken, only the hinge allows the band to be held in place. Therefore, in order to hold the stopper in place without the risk of the band slipping along the neck of the bottle when opening the cap, it is known to adapt the neck of the bottle at an annular bead, on which the band will then bear. Such a stopper, mounted on a neck of a bottle adapted to the stopper, is shown in EP-0 685 406.

The main drawback of this solution is that the bottle or the container must be adapted to the stopper. In addition, this adapted bead increases the cost of the bottle as it requires additional material.

The object of the invention is therefore to provide a stopper which is well held on the neck of the container for which it is intended without, however, requiring this neck to be adapted.

For this purpose, the stopper that it provides is a stopper made of synthetic material having a cap hinged to a band, intended for sealing a container, a hinge being provided for allowing the cap to be hinged to the band in the plane of the opening of the container or above the opening, and a bead being provides to allow the snap-fastening of the stopper on a neck of the container.

SUMMARY OF THE INVENTION

According to the invention, at least one protuberance, projecting towards the interior of the stopper, is made on the band beneath the hinge for articulating the cap to the band, this at least one protuberance being able to bear on a part which is fixed in relation to the container.

This protuberance makes it possible to hold the band in position, especially when opening the cap. This protuberance takes the downwardly directed axial forces, i.e. those directed towards the body of the container, and can bear, for example, on a rim of the neck of the container or on any other part fixed with respect to the container which lies opposite it.

In a stopper according to the invention, the protuberance must be adapted to the surrounding configuration, and it is no longer necessary to shape the neck of the container so that it holds the band of the stopper in place.

In a first embodiment, the protuberance is made on the band near the hinge. Such a protuberance then bears, for example, on the rim of the neck of the container.

In a second embodiment, the protuberance consists of an annular bead made on the internal surface of the band. Such a protuberance then bears, for example, on an annular bead on the neck of the container, serving to hold the container in place when filling the latter.

In the first embodiment, the stopper has a protuberance advantageously extending over approximately half the length of the hinge.

The invention may also apply to a stopper which is equipped with a pourer fitted into the opening of the container. In this case, the protuberance advantageously bears on the pourer.

In one embodiment of the invention, the stopper is provided with means allowing evidence of the cap having been opened for the first time, which means, before first use, connect the cap to the band over a large part of the periphery of the cap.

In any case, the invention will be clearly understood with the aid of the description which follows, with reference to the appended diagrammatic drawing representing, by way of non-limiting examples two embodiments of a stopper according to the invention.

BRIEF DESCRIPTION OF THE DRAWINGS

FIG. 1 is a perspective view of a stopper according to the invention,

FIG. 2 is a longitudinal sectional view on an enlarged scale of the stopper of the previous figure, mounted on a container neck, provided with a pourer and in the closed position.

Figure 3:
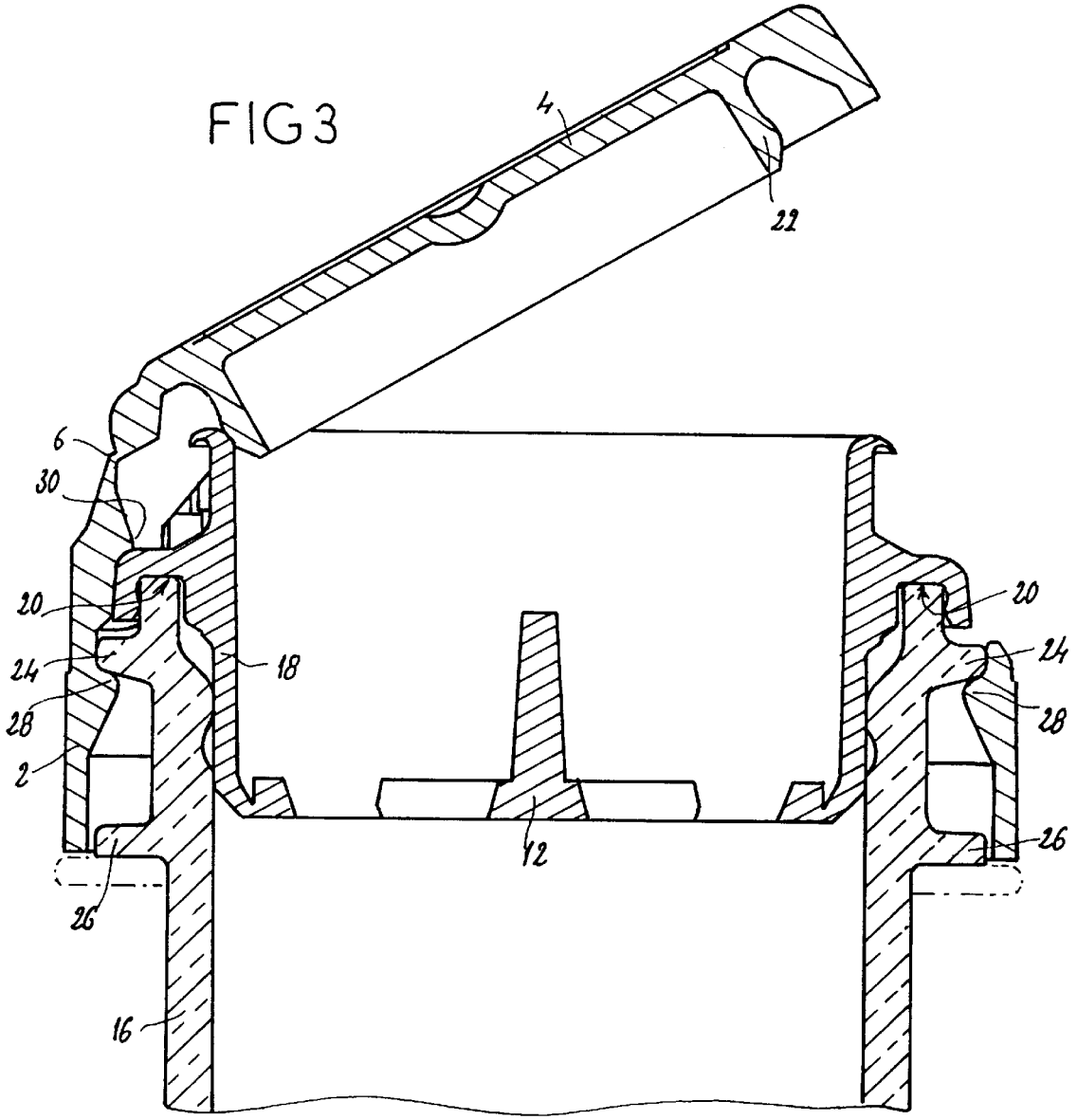
FIG. 3 is a view corresponding to FIG. 2, the stopper-being in the open position.

The figures show a stopper comprising a band 2 and a cap 4 hinged to the band 2 by means of a hinge 6.

DESCRIPTION OF THE PREFERRED

In the closed position of the cap 4 and before the latter has been opened for the first time, a tearable tamper-evident ring 8 connects the cap 4 to the band 2. This ring 8 extends approximately from one end of the hinge 6 to the other end of this hinge, extending over the greater part of the periphery of the cap 4. Regions of thin material 10 form the link between the ring 8, on the one hand, and the cap 4 or the band 2, on the other hand, thus allowing the tamper-evident ring 8 to be torn off.

Figure 4:
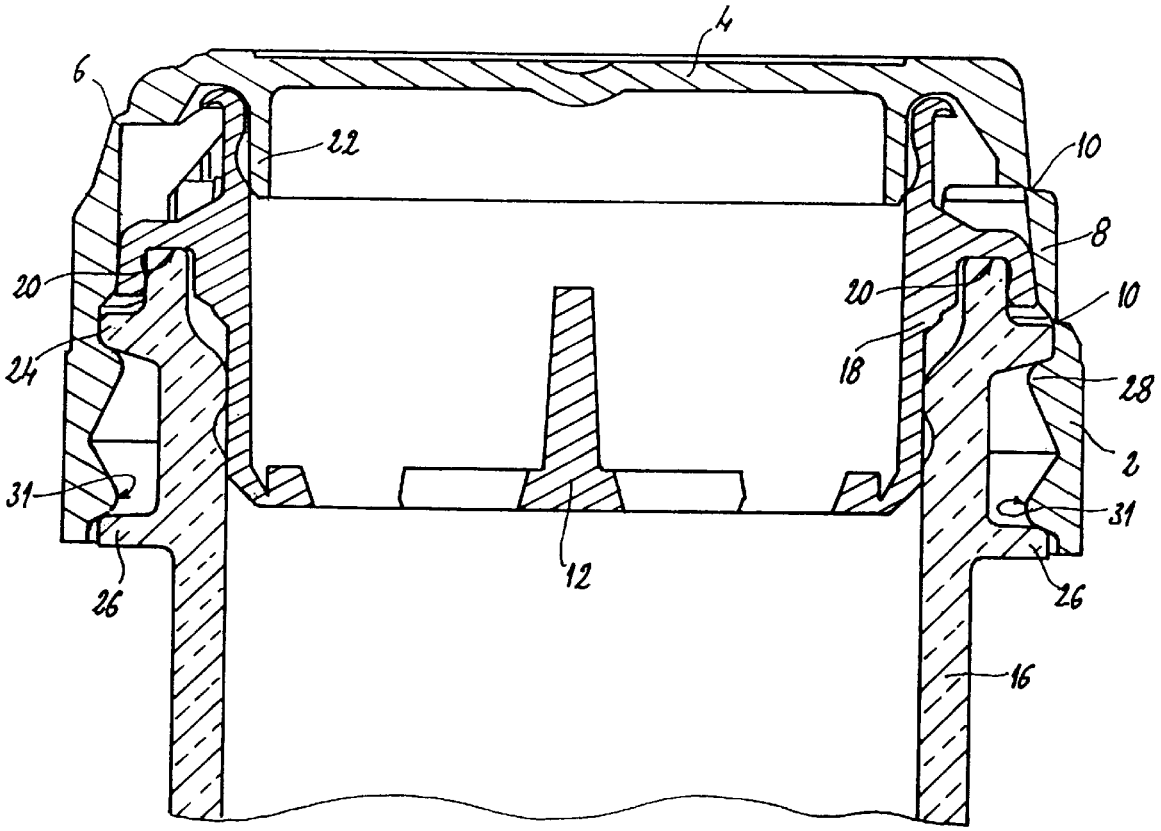
FIG. 4 is a view similar to FIG. 2 and showing a second embodiment of a stopper according to the invention.

The stopper as shown in FIGS. 2 to 4 is provided with a pourer 12. The latter prevents a drop of liquid from flowing along the external wall of the container when liquid contained in the container is poured out.

The pourer 12 is fitted into the opening of a neck of the container 16. It has a circular cylindrical part 18 which engages in the opening and which also extends to the outside of the container. In order to hold the pourer 12 in place on the neck of the container 16, an axial annular groove 20 is provided on the outside of the cylindrical part. This groove 20 fits over the edge of the neck of the container 16, thus allowing the pourer to be properly held on the neck of the container 16.

The cap 4 has a chimney 22 which engages with the cylindrical part 18 of the pourer 12 in order to close the stopper. The hinge 6 connecting the cap 4 to the band 2 lies above the plane of the opening.

The neck of the container 16 has two peripheral annular beads. A first 24 of these beads, placed near the opening, is intended to allow the stopper to be snap-fastened onto the neck of the container 16. The second 26 of these beads is located below the first, that is to say that it is further away from the opening, and serves to hold the bottle when filling it and when the stopper is snap-fastened on.

In order to allow the stopper to be snap-fastened onto the neck of the container 16, a peripheral annular bead 28 is made on the internal surface of the band 2. It engages with the first bead 24 of the neck of the container 16.

When the stopper is in the closed position on the neck of the container 16, the cap 4 helps to hold the band 2 in place, especially when the tamper-evident ring 8 has not yet been torn off.

Once the tamper-evident ring 8 has been removed, the band 2 is now held in place only by the hinge 6. When opening the cap 4, an axial force is exerted at the hinge 6 on the band 2, tending to move the latter down, that is to say that it engages more on the neck of the container 16.

According to the invention (FIGS. 2 and 3), a protuberance 30 is made below the hinge 6 in order to prevent the band 2 from moving axially downwards. The protuberance 30 allows the band 2 to be fastened to the rim of the pourer 12 in which the axial groove 20 is made. The band 2 is then perfectly held in place near the hinge 6 by, on the one hand, the bead 28 engaging with the first bead 24 of the neck of the container and by, on the other hand, the protuberance 30.

It has proved to be the case that holding the band 2 in place by means of the protuberance 30 and, of course, by means of the bead 28, is sufficient to prevent the band from moving when the stopper is being used. In fact, the force exerted on the band 2 is transferred solely by the hinge 6 and a protuberance placed at this point makes it possible to hold the band 2 firmly in place.

The protuberance 30 in the embodiment shown in the drawing extends only over approximately half the length of the hinge 6. This length is sufficient for good retention and good results when opening and closing the cap 4.

FIG. 4 shows a second embodiment of a stopper according to the invention. In this embodiment, the protuberance 30 is omitted and is replaced by an annular bead 31 extending over the entire internal, perimeter of the band 2. This annular bead 31 is placed just above the annular bead 26 serving for holding the bottle when filling it.

In this embodiment, the annular bead 31 is placed further away from the hinge 6 than in the first embodiment. It is then preferable for the annular bead 31 to be more extensive than the protuberance 30 since the axial forces transferred by the hinge 6 are distributed over the entire perimeter of the band 2.

Stoppers of this type in the prior art do not have a protuberance 30 and the band is then held in place by the second annular bead 26 of the neck of the container 16. This bead 26 must therefore be adapted to its function of holding the band in place. Such a bead as shown in the drawing does not hold the band in place in the absence of the annular bead 31. To do this, it is necessary to have a larger bead which extends under the band 2. The dotted lines in FIG. 3 show the shape of a bead cross-section of the prior art. It is found that the cross-section of the bead for a stopper according to the invention is substantially smaller than that for a stopper of the prior art. This therefore results in a not insignificant weight saving of raw material.

As goes without saying, the invention is not limited to the embodiment described above by way of non-limiting example; on the contrary, it encompasses all variants thereof.

Thus, for example, the stopper is not necessarily provided with a pourer. The protuberance may bear not on the pourer but directly on the neck of the container.

The position of the protuberance and its size may vary. In the first embodiment shown, the protuberance is just beneath the hinge in the centre of the latter. It is possible, for example, to have two protuberances, one under each end of the hinge or in another position.

In the second embodiment, the annular protuberance may be replaced by several "discrete" protuberances distributed around the internal perimeter of the band, or by any other equivalent protuberance(s).

The stopper according to the invention does not necessarily include a tearable tamper-evident ring. Frangible connecting straps may, for example, also connect the cap to the band of the stopper.

What is claimed is:

1. A stopper made of synthetic material comprising:

a band having an internal surface oriented towards an interior of the stopper;

a cap for sealing a container and being articulated to the band by a hinge allowing the cap to be hinged to the band in a plane of an opening of the container or in a plane above the opening;

an annular bead formed on the internal surface of the band to allow a snap-fastening of the stopper on a neck of the container and to prevent an upward movement of the band on the neck relative to the container while opening and closing the cap; and a non-annular protuberance formed on only one portion of the internal surface of the band above the annular bead, to bear on the portion which is fixed in relation to the container, and to prevent a downward movement of the band on the neck relative to the container while opening and closing the cap.

2. The stopper according to claim 1, wherein the non-annular protuberance is formed on the band immediately adjacent the hinge.

3. The stopper according to claim 1, wherein the non-annular protuberance extends for approximately half a length of the hinge.

4. The stopper according to claim 1, further comprising a pourer fitted into the opening of the container.

5. The stopper according to claim 4, wherein the protuberance bears on the pourer.

6. The stopper according to claim 1, further comprising a tamper evident element connecting the cap to the band, the tamper evident element indicating an initial movement of the cap relative to the band.

7. A stopper made of synthetic material comprising:

a band having an internal surface oriented towards an interior of the stopper;

a cap for sealing a container and being articulated to the band by a hinge allowing the cap to be hinged to the band in a plane of an opening of the container or in a plane above the opening;

a first annular bead formed on the internal surface of the band to allow a snap-fastening of the stopper on a neck of the container and to prevent an upward movement of the band on the neck relative to the container while opening and closing the cap; and a second annular bead formed on the internal surface of the band and below the first annular bead to bear on a portion which is fixed in relation to the container and to prevent a downward movement of the band on the neck relative to the container while opening and closing the cap.

8. The stopper according to claim 7, further comprising a pourer fitted into the opening of the container.

9. The stopper according to claim 7, further comprising a tamper evident clement connecting the cap to the band, the tamper evident element indicating an initial movement of the cap relative to the band.

* * * * *

UNITED STATES PATENT AND TRADEMARK OFFICE

CERTIFICATE OF CORRECTION

PATENT NO. : 6,283,317 B1
DATED : September 4, 2001
INVENTOR(S) : Benoit-gonin et al.

It is certified that error appears in the above-identified patent and that said Letters Patent is hereby corrected as shown below:

Title page,
Item [73], Assignee, after "Corporation," delete "Alsep," and insert therefor -- Alsip --

Column 2,
Line 50, after "PREFERRED" insert therefor -- EMBODIMENT --

Signed and Sealed this

Twenty-second Day of March, 2005

JON W. DUDAS
*Director of the United States Patent and Trademark Office*